United States Patent [19]

Hawkins

[11] Patent Number: 4,533,127

[45] Date of Patent: Aug. 6, 1985

[54] WHEELED STAND

[76] Inventor: Joel W. Hawkins, Box 3867, Greenville, S.C. 29608

[21] Appl. No.: 539,755

[22] Filed: Oct. 6, 1983

[51] Int. Cl.[3] ..... B66F 3/00

[52] U.S. Cl. ..... 269/17; 269/47

[58] Field of Search ..... 254/8 B, 8 R, 7 B, 7 R, 254/4 B, 4 R; 269/17, 47, 52; 188/1.12, 29, 74, 83; 16/35 R, 42 R, 42 T, 43, 39

[56] References Cited

U.S. PATENT DOCUMENTS

| | | | |
|---|---|---|---|
| 1,555,839 | 10/1925 | Fries et al. | 16/39 |
| 1,614,697 | 1/1927 | Snook | 269/17 |
| 2,895,729 | 7/1959 | Sanders | 269/17 |
| 3,154,290 | 10/1964 | Johnson | 254/8 B |
| 3,218,056 | 11/1965 | Kaplan et al. | 269/17 |
| 3,381,953 | 5/1968 | Miller | 269/17 |
| 3,521,860 | 7/1970 | Zehrung | 254/8 R |
| 3,931,956 | 1/1976 | Hawkins | 254/8 B |
| 4,183,511 | 1/1980 | Marek | 269/17 |

*Primary Examiner*—Robert C. Watson

*Attorney, Agent, or Firm*—Bailey & Hardaway

[57] ABSTRACT

A wheeled stand especially useful as an automotive engine stand is illustrated wherein a post is inclined rearwardly from its point of attachment between outwardly tapering sections which form a longitudinal base portion, said post being tilted rearwardly and supported by upright straps. A wheel locking mechanism is provided wherein a threaded member is vertically disposed and provided with a wing portion, said threaded member being movable in and out of locking engagement with a peripheral portion of the wheel.

3 Claims, 3 Drawing Figures

WHEELED STAND

BACKGROUND OF THE INVENTION

The prior art is illustrated in the drawings as including an engine stand supported by casters which includes a single forwardly extending tubular section affording together with the transverse base section, a three point support. The post is vertical and must be welded to the base or welded to something which has a fixed connection with or is a part of the base. Relatively expensive locking mechanism must be provided for the wheeled supports since locking must be provided when exerting a torque upon engine parts during use of the stand. Since such a torque is transferred to the stand, such would otherwise cause stand to move about. Since the posts are welded and have a substantial bending moment placed therein by the engine being in canterlevered relationship therewith, the parts must be constructed from relatively heavy expensive material. The resulting stands must be shipped in assembled relation. U.S. Pat. Nos. 3,381,953 and 3,931,956 are illustrative of the prior art.

Accordingly, it is an important object of this invention to provide an improved post arrangement wherein the post is inclined rearwardly from a pivot point between a pair of diverging base forming members and supported by upright straps so as to provide stability avoiding rocking in all directions.

Another important object of the invention is the provision of a thumb screw brake for use on the wheels of the stand to avoid movement of the stand when torquing the engine which includes an upright threaded member which may be manually moved into and out of braking engagement with a peripheral portion of the wheel.

Still another important object of the invention is to provide an engine stand which may be disassembled with the parts being folded together to facilitate shipping. The particular structure also makes possible the use of lighter, less expensive construction material while providing increased stability.

SUMMARY OF THE INVENTION

It has been found that a more stable wheeled stand may be provided utilizing a post carried between a pair of diverging base members which is tilted rearwardly and supported by a pair of upwardly converging straps for engagement with the post. The parts may be disassembled for shipping and greater stability is provided. A thumb screw braking arrangement is provided utilizing a threaded shank which is adjustable into and out of braking arrangement with the wheels.

It has been found that by utilizing the above construction, greater stability may be afforded together with the provision of a four wheel rather than a three wheel support.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an engine stand having a wheeled base formed from a tubular transverse base member and a longitudinal base portion which extends forwardly from the transverse base member. A post is carried by the longitudinal base portion inclined rearwardly toward the transverse base portion. A pair of upright straps B are carried by the transverse base member on one end, tapering inwardly toward and being connected to the post on the other end. Engine mounting means C are carried adjacent an upper end of the post extending outwardly above and in alignment with the longitudinal base portion. The longitudinal base portion includes a pair of structural members each having a first section D extending outwardly from the transverse base member in general longitudinal alignment, and a second section E diverging outwardly from each of the first sections. Fastening means securing the post between said first sections remote from the transverse base member. An upper bridging member F and depending supports carried thereby, carry a wheel mounted for rotation between the depending supports. An adjustable threaded member G is carried by the bridging member extending into and out of braking engagement with a peripheral portion of the wheel.

Figure 1:
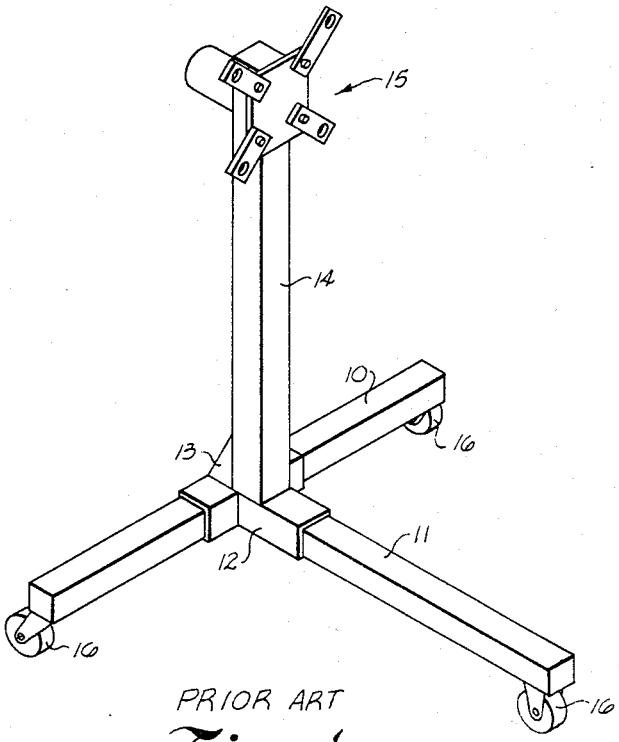
PRIOR ART Fig. 1
FIG. 1 is a perspective view illustrating an engine stand constructed in accordance with the prior art.

Referring more particularly to the drawings, FIG. 1 illustrates the prior art as including a transverse base member 10 constructed of a tubular section. A longitudinally extending tubular section 11 is secured to a junction member 12. The transverse base member 10 may be constructed in two parts which are connected to the junction member 12. A gusset plate 13 is provided to support the post member 14 which is welded thereto and to the junction member 12. Engine mounting means are broadly designated at 15 and are positioned atop the post 14. The stand is illustrated as being supported by casters 16 although the braking mechanism which generally includes a foot operated lever has been omitted.

Figure 2:
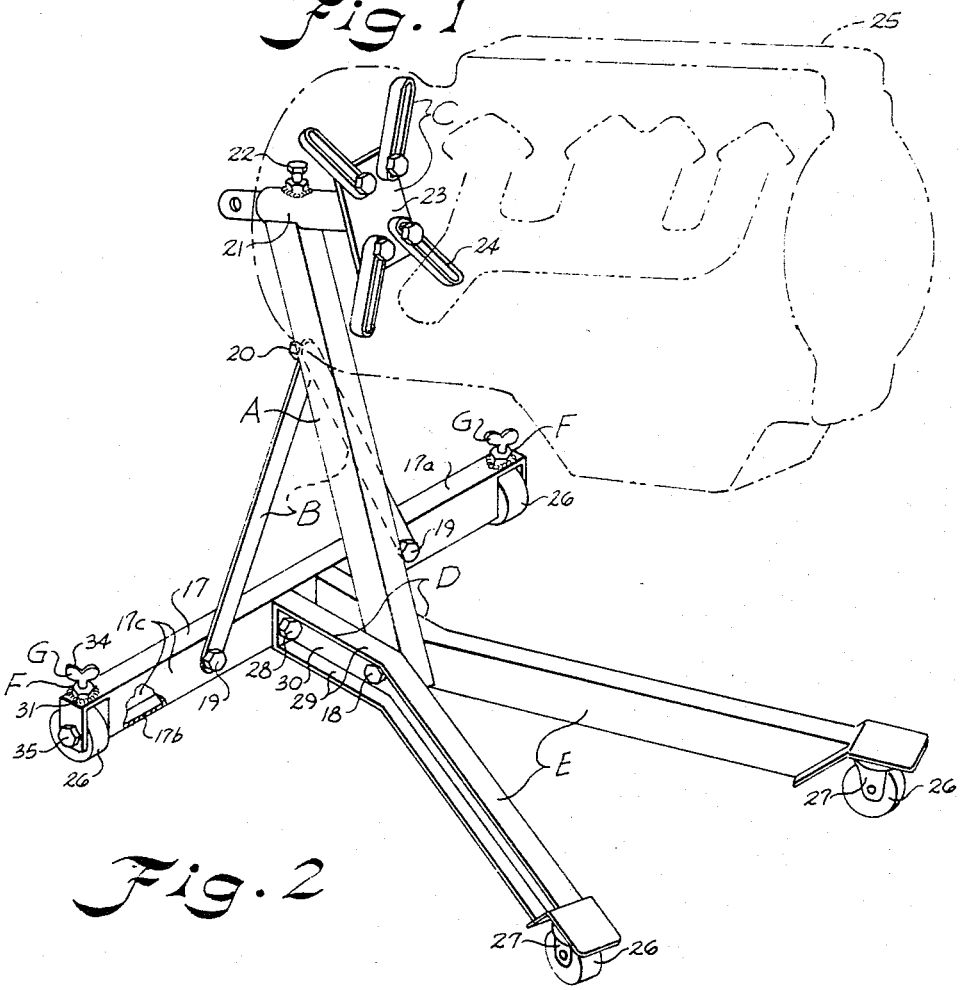
FIG. 2 is a perspective view illustrating an engine stand constructed in accordance with the present invention wherein the main support post is inclined rearwardly and supported by upright straps and wherein upright thumb screws are provided for engaging the periphery of the wheels at right angles thereto.

FIG. 2 illustrates the engine stand constructed in accordance with the invention wherein a wheeled base is formed from a tubular transverse member 17 which includes an upper bridging or web portion 17*a* opposite a lower web portion 17*b*. A pair of sides or flanges are illustrated at 17*c*.

A longitudinal base portion extends forwardly from the transverse tubular base member 17 and serves as a mounting for a lower portion of the post A which includes a base portion which is pivotally carried as at 18 between the first sections of the longitudinal base portion which has diverging second sections extending outwardly therefrom. A post A is supported by a pair of upright, substantially vertical straps B each of which is secured as by a bolt 19 to an intermediate portion of the transverse base member 17 which extends on either side of the longitudinal base portion. The strap members converge upwardly and are connected as by the bolt 20 to a single point on the tubular post B. An engine mounting means which may be of any standard variety is illustrated at C which includes a support member 21 removably secured by a threaded fastener 22. A support plate 23 is carried by the base 21 and adjustable links 24 are provided for affording a four point securement for the engine illustrated in broken lines at 25.

The base is illustrated as being supported by wheels 26 carried adjacent the ends of the transverse base member and adjacent the diverging end of the longitudinal base portion. A swivel arrangement 27 forms a standard caster arrangement supporting the free ends of the longitudinal base portion.

The longitudinal base portion includes a pair of structural members each having a first section D which is secured as by bolts 28 to an adjacent flange 17*c* of the transverse base member. The first section D is illustrated in the form of a channel member having flanges 29 and a web 30. The second section E is formed by a diverging continuation of the first sections D and form together with the wheels carried at the extremities of the transverse base member a four point support for the wheeled base.

Figure 3:
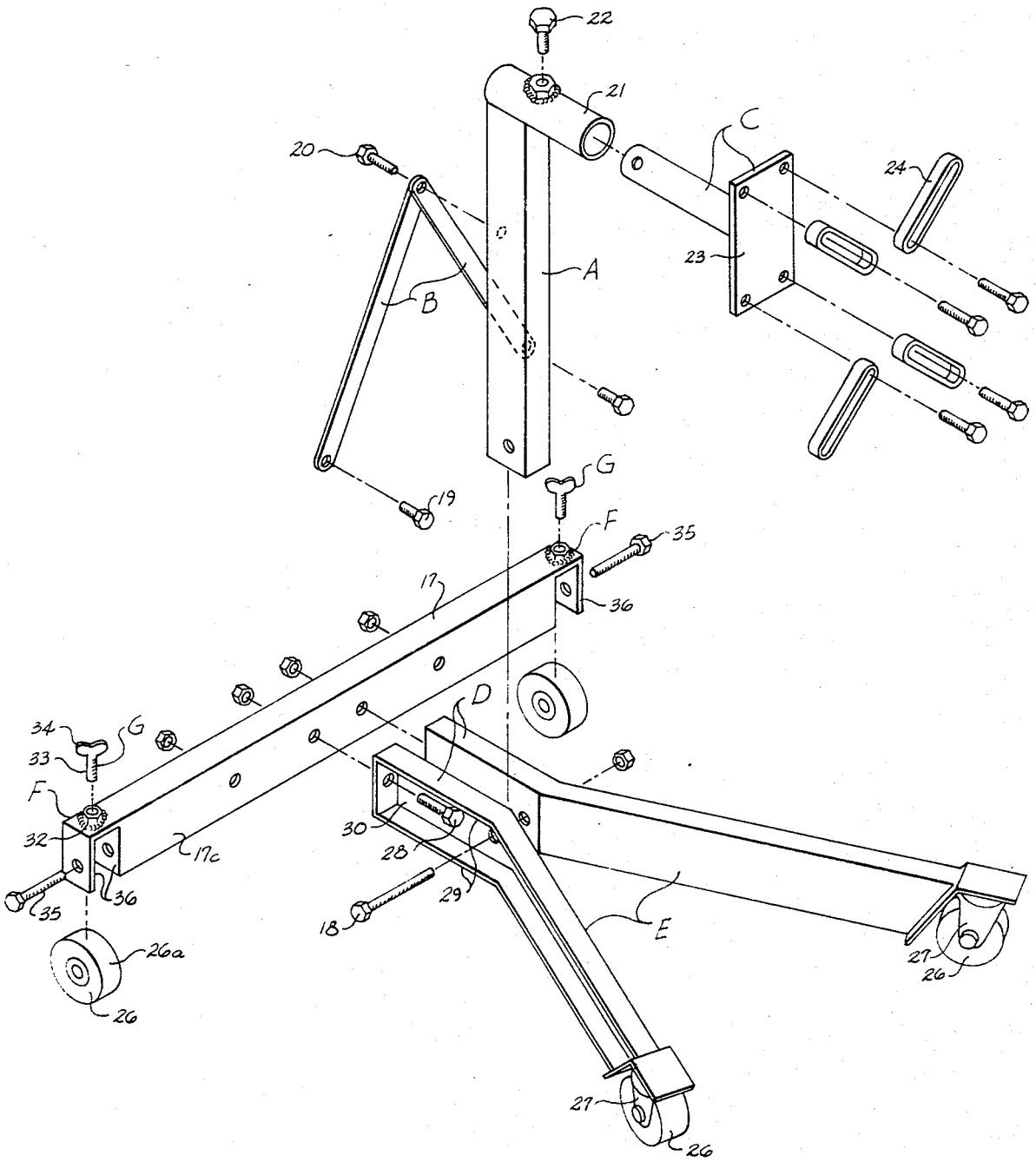
FIG. 3 is a perspective view illustrating the various parts preparatory to assembly.

The braking mechanism is provided by an upper bridging member which is illustrated as being an outward extension of the web portion 17*a* of the tubular transverse base member. The braking mechanism includes an adjustable threaded member G which is carried in an upright internally threaded portion 31 which has a threaded opening 32 extending through the bridging member F so that the threaded opening 32 (FIG. 3) of the threaded member G may receive the threaded shank 33 of the adjustable member G. A wing nut is formed by the wing portion 34 carried by the shank 33 which permits use of the member G as a thumb screw for manual adjustment into and out of braking engagement. The free end of the threaded shank 33 engages the outer periphery 26*a*, in this case, at right angles thereto. The wheel 26 is carried for rotation on the member 35 between the depending supports 36.

While a preferred embodiment of the invention has been described using specific terms, such description is for illustrative purposes only and it is to be understood that changes and variations may be made without departing from the spirit or scope of the following claims.

What is claimed is:

1. An engine stand having a base formed from a transverse base member, and a longitudinal base portion extending forwardly from said transverse base member; said base being supported by wheels, comprising:

a post carried by said longitudinal base portion and being inclined rearwardly toward said transverse base portion;

a pair of upright straps carried by said transverse base member on one end and tapering inwardly toward and being removably connected to said post on the other end;

engine mounting means carried adjacent an upper end of said post extending outwardly above and in alignment with said longitudinal base portion;

said longitudinal base portion including a pair of structural members each having a first section extending removably outwardly from said transverse base member in general longitudinal alignment;

a second section diverging outwardly from each of said first sections; and fastening means removably securing said post between said first sections remote from said transverse base member.

2. The structure set forth in claim 1 wherein said transverse base member is of tubular construction, an upper bridging member and depending supports carried thereby, a wheel mounted for rotation between said depending supports;

and an adjustable threaded member carried by said bridging member extending into and out of braking engagement with a peripheral portion of said wheel.

3. The structure set forth in claim 2 including an upright internally threaded portion carrying said adjustable threaded member, and a wing portion carried by said adjustable threaded member to facilitate manual braking.

* * * * *